US010336097B2

(12) United States Patent
Yamada et al.

(10) Patent No.: US 10,336,097 B2
(45) Date of Patent: Jul. 2, 2019

(54) PRINTING APPARATUS AND PRINTING METHOD

(71) Applicant: CANON KABUSHIKI KAISHA, Tokyo (JP)

(72) Inventors: Akitoshi Yamada, Yokohama (JP); Junichi Nakagawa, Tokyo (JP); Yoshikazu Ishikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/821,653

(22) Filed: Nov. 22, 2017

(65) Prior Publication Data

US 2018/0147840 A1 May 31, 2018

(30) Foreign Application Priority Data

Nov. 30, 2016 (JP) ..... 2016-233347

(51) Int. Cl.
*B41J 2/51* (2006.01)
*B41J 3/54* (2006.01)
*B41J 19/14* (2006.01)

(52) U.S. Cl.
CPC ..... *B41J 2/51* (2013.01); *B41J 2/512* (2013.01); *B41J 3/543* (2013.01); *B41J 19/147* (2013.01)

(58) Field of Classification Search
CPC ..... B41J 3/543
See application file for complete search history.

(56) References Cited

U.S. PATENT DOCUMENTS 6,020,976 A * 2/2000 Fujita ..... B41J 3/543 347/3
6,641,251 B1 11/2003 Rodriguez
2007/0097197 A1* 5/2007 Kremers ..... B41J 2/2103 347/102
2014/0015887 A1 1/2014 Seccombe
2016/0257129 A1 9/2016 Ohara

FOREIGN PATENT DOCUMENTS

EP 1208991 A2 5/2002
JP 10-044389 A 2/1998

* cited by examiner

*Primary Examiner* — Julian D Huffman
(74) *Attorney, Agent, or Firm* — Canon U.S.A., Inc. IP Division

(57) ABSTRACT

A printing apparatus uses a printing unit on which a right and a left printing heads are mutually arranged in opposite orientations in a predetermined direction to execute multi-pass printing.

21 Claims, 12 Drawing Sheets

PRINTING APPARATUS AND PRINTING METHOD

BACKGROUND OF THE INVENTION

Field of the Disclosure

The present disclosure relates to a printing apparatus and a printing method.

Description of the Related Art

There is provided a printing apparatus which prints an image by repeatedly executing printing scan in which ink is discharged while relatively moving a printing unit including discharge port arrays including a plurality of discharge ports for discharging ink arranged in rows with respect to a unit area of a print medium.

For the above-described printing apparatus, shortening the time taken for executing printing on a print medium has grown in demand. In order to achieve shortening of the printing time, Japanese Patent Application Laid-Open No. 10-044389 discusses a printing unit which includes printing heads, having a plurality of discharge port arrays for discharging a plurality of color inks, mounted on the right and the left sides thereof in a scanning direction. In Japanese Patent Application Laid-Open No. 10-044389, by using the above-described printing unit, ink is discharged from only a left-side printing head to a left-side area of the print medium in the scanning direction, while ink is discharged from only a right-side printing head to a right-side area in the scanning direction. With this configuration, printing time can be shortened because the printing unit can complete printing without scanning the entire area spanning from a position facing the left end portion of the print medium to a position facing the right end portion of the print medium.

In the above-described printing apparatus, as illustrated in FIG. 2B of Japanese Patent Application Laid-Open No. 10-044389, it is known that one printing head and another printing head are arranged on the printing unit in opposite orientations. Specifically, in Japanese Patent Application Laid-Open No. 10-044389, printing heads including a plurality of discharge port arrays, which is for discharging a plurality of color inks, arranged in an arrangement direction of the discharge ports are used, and the printing heads are arranged on the right side and the left side in opposite orientations, so that the discharge port arrays of the left-side printing head are arranged in the order of black, cyan, magenta, and yellow from the upper side to the lower side in the arrangement direction, whereas the discharge port arrays of the right-side printing head are arranged in the order of yellow, magenta, cyan, and black from the upper side to the lower side in the arrangement direction. Because two identical printing heads are used when the printing heads are arranged on the printing unit in the above-described state, the production cost can be lowered and a user can be prevented from erroneously attaching the printing head when replacement work is performed.

However, when the above-described printing unit on which two printing heads are arranged in the opposite orientations is used, color difference occurs in an area where printing is executed by only the left-side printing head and an area where printing is executed by only the right-head printing head, which may lower image quality.

For example, in a case where so-called "one-pass printing" in which color inks are discharged on a unit area through one time of scanning is executed by using the printing unit illustrated in FIG. 2B described in Japanese Patent Application Laid-Open No. 10-044389, color inks are applied to one area in the order of black, cyan, magenta, and yellow, while the color inks are applied to another area in the order of yellow, magenta, cyan, and black.

When a plurality of color inks are applied in different orders, colors of acquired images may be different from each other even if ink of the same color and the same amount is used. Such color difference occurs in the area where printing is executed by only the left-side printing head and the area where printing is executed by only the right-side printing head, which may lower the image quality.

SUMMARY

The present disclosure is directed to a technique of executing printing while reducing color difference between a right and a left areas when a printing unit on which a right and a left printing heads are arranged in opposite orientations is used.

According to an aspect of the present disclosure, a printing apparatus includes a printing unit which includes a first printing head on which a discharge port array consisting of a plurality of discharge ports for discharging ink arranged in a predetermined direction is arranged and a second printing head on which a discharge port array consisting of a plurality of discharge ports for discharging ink arranged in the predetermined direction is arranged, the first printing head and the second printing head being arranged so as to be separated from each other in an intersection direction intersecting with the predetermined direction, a scanning unit configured to scan a print medium by alternately moving the printing unit forward and backward in the intersection direction, and a control unit configured to control discharge of ink while causing the scanning unit execute scanning in such a manner that printing on a first area of the print medium is executed by using the first printing head without using the second printing head and printing on a second area different from the first area in the intersection direction of the print medium is executed by using the second printing head without using the first printing head, wherein a plurality of discharge port arrays for discharging a plurality of different color inks is arranged on each of the first and the second printing heads in a same arrangement order in the intersection direction, wherein the first and the second printing heads are mounted on the printing unit in such a manner that the first and the second printing heads are mutually placed in opposite orientations in the predetermined direction, and wherein the control unit controls discharge of ink in such a manner that an image is printed on a unit area including at least a part of the first area and a part of the second area by discharging ink from the plurality of discharge port arrays through a plurality of times of scanning executed by the scanning unit.

Further features of the present disclosure will become apparent from the following description of exemplary embodiments with reference to the attached drawings.

DESCRIPTION OF THE EMBODIMENTS

Hereinafter, a first exemplary embodiment of the present disclosure will be described in detail with reference to the drawings.

Figure 1:
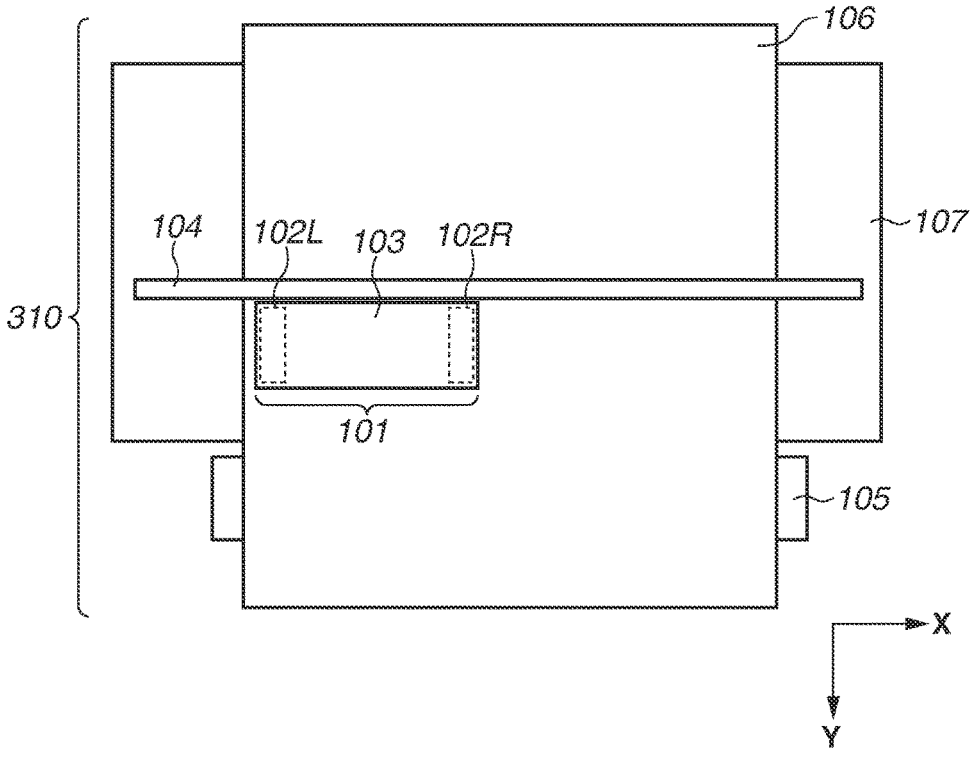
FIG. 1 is a schematic diagram illustrating an internal configuration of a printing apparatus according to one or more aspects of the present disclosure.

FIG. 1 is a diagram schematically illustrating an internal configuration of an ink jet printing apparatus 310 of the present exemplary embodiment.

The ink jet printing apparatus (hereinafter, also referred to as "printer" or "printing apparatus") 310 of the present exemplary embodiment includes a printing unit 101. The printing unit 101 includes a printing head 102L and a printing head 102R, and these printing heads 102L and 102R are held by a single holding unit 103. A chip 113 is arranged on the printing head 102L, and a chip 114 is arranged on the printing head 102R. Discharge port arrays which discharges a black ink, a cyan ink, a magenta ink, and a yellow ink are arranged on each of the chips 113 and 114. Details of these units will be described below. Hereinafter, for the sake of simplicity, the discharge port array arranged on the chip 113 is described as a discharge port array arranged on the printing head 102L. Similarly, the discharge port array arranged on the chip 114 is also described as a discharge port array arranged on the printing head 102R.

The printing unit 101 can move (scan) in forward and backward in the X-direction (i.e., an intersection direction or a scanning direction) along a guide rail 104 arranged and extended in the X-direction with respect to a print medium 106. Further, the print medium 106 is supported by a platen 107 and conveyed in the Y-direction (i.e., conveyance direction) through rotation of a conveyance roller 105. The ink jet printing apparatus 310 according to the present exemplary embodiment completes printing with respect to the entire area of the print medium 106 by repeatedly executing printing operation along with scanning in the X-direction performed by the above-described printing unit 101 and conveyance operation of the print medium 106 in the Y-direction through the conveyance roller 105.

Figure 2A:
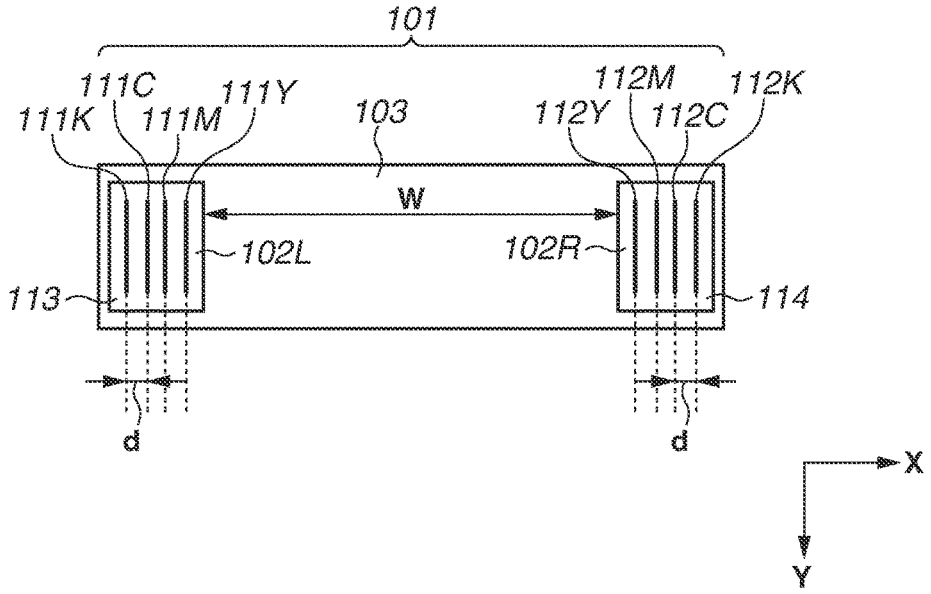
FIGS. 2A and 2B are diagrams illustrating a printing unit according to the exemplary embodiment.
Figure 2B:
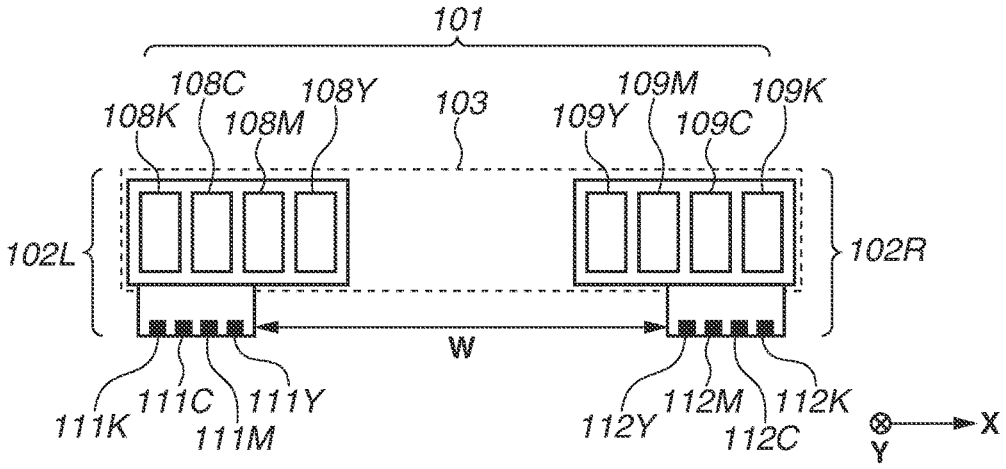

FIGS. 2A and 2B are diagrams illustrating details of the printing unit 101 described in the present exemplary embodiment. FIG. 2A is a diagram schematically illustrating the printing unit 101 viewed from a vertically lower position with respect to an X-Y plane. Further, FIG. 2B is a diagram schematically illustrating the printing unit 101 viewed in the Y-direction.

Two printing heads 102L and 102R are mounted on the printing unit 101 of the present exemplary embodiment. The printing heads 102L and 102R are arranged inside the printing unit 101 so as to be separated from each other by a distance W. The printing heads 102L and 102R have the same configuration, and four discharge port arrays which discharge a cyan ink, a magenta ink, a yellow ink, and a black ink, respectively, are arranged.

A first mounting unit (not illustrated) on which the printing head 102L can be mounted and a second mounting unit (not illustrated) on which the printing head 102R can be mounted are arranged on the holding unit 103. The first and the second mounting units are arranged on the holding unit 103 so as to make the printing heads 102L and 102R be mutually placed in the opposite orientations in the Y-direction, i.e., in the orientations rotated by 180-degree, when the printing heads 102L and 102R are mounted thereon. Accordingly, although the printing heads 102L and 102R have the same configuration, the arrangement orders of discharge port arrays of colors in the X-direction are different from each other when the printing heads 102L and 102R are mounted on the printing unit 101.

Specifically, when the printing head 102L is mounted on the printing unit 101, a black ink discharge port array 111K, a cyan ink discharge port array 111C, a magenta ink discharge port array 111M and a yellow ink discharge port array 111Y are arranged in that order starting from the left side in the X-direction. On the contrary, when the printing head 102R is mounted on the printing unit 101, a yellow ink discharge port array 112Y, a magenta ink discharge port array 112M, a cyan ink discharge port array 112C, and a black ink discharge port array 112K are arranged in that order starting from the left side in the X-direction. This is due to the arrangement in which the printing heads 102L and 102R are mounted in mutually opposite orientations in the Y-direction, and thus it can be seen that the printing heads 102L and 102R have the same configuration when the printing heads 102L and 102R are detached from the printing unit 101.

Four discharge port arrays 111C, 111M, 111Y, and 111K are arranged on the printing head 102L so as to be separated from each other by the same distance "d". Then, a plurality of discharge ports (not illustrated) for discharging the color inks is arranged on each of the discharge port array 111C, 111M, 111Y, and 111K in the Y-direction (i.e., a predetermined direction or an arrangement direction). Each of the discharge ports is manufactured to discharge ink at a discharge amount of 3 ng.

Then, each discharge port in the printing head 102L is connected to an ink tank for storing ink via a flow path (not illustrated). Specifically, discharge ports arranged in the discharge port array 111C are connected to an ink tank 108C for storing a cyan ink, discharge ports arranged in the discharge port array 111M are connected to an ink tank 108M for storing a magenta ink, discharge ports arranged in the discharge port array 111Y are connected to an ink tank 108Y for storing a yellow ink, and discharge ports arranged in the discharge port array 111K are connected to an ink tank 108K for storing a black ink.

As described above, because the printing heads 102R and 102L have the same configuration, arrangements of the discharge port arrays and the ink tanks are also the same.

Specifically, four discharge port arrays 112C, 112M, 112Y, and 112K are arranged on the printing head 102R so as to be separated from each other by a same distance Then, a plurality of discharge ports (not illustrated) for discharging color inks is arranged on each of the discharge port arrays 112C, 112M, 112Y, and 112K in the Y-direction (i.e., a predetermined direction or an arrangement direction).

Then, the discharge ports in the printing head 102R are connected to ink tanks for storing inks via flow paths (not illustrated). Specifically, discharge ports arranged in the discharge port array 112C are connected to an ink tank 109C for storing a cyan ink, discharge ports arranged in the discharge port array 112M are connected to an ink tank 109M for storing a magenta ink, discharge ports arranged in the discharge port array 112Y are connected to an ink tank 109Y for storing a yellow ink, and discharge ports arranged in the discharge port array 112K are connected to an ink tank 109K for storing a black ink respectively.

Although the configuration in which a discharge port array included in the printing head 102L and a discharge port array included in the printing head 102R which discharge ink of the same color are connected to separate ink tanks has been described, the discharge port arrays may be connected to the same ink tank. Further, in both of the configuration in which the separate ink tanks are used and the configuration in which the same ink tank is used, the printing unit 101 can be miniaturized by arranging the ink tank(s) at a position close to the center of the holding unit 103 in the X-direction. However, for example, if miniaturization thereof is not taken into consideration, the printing unit 101 may be designed so as to make central portions of printing heads and ink tanks approximately conform to each other when two different ink tanks are used.

Figure 3:
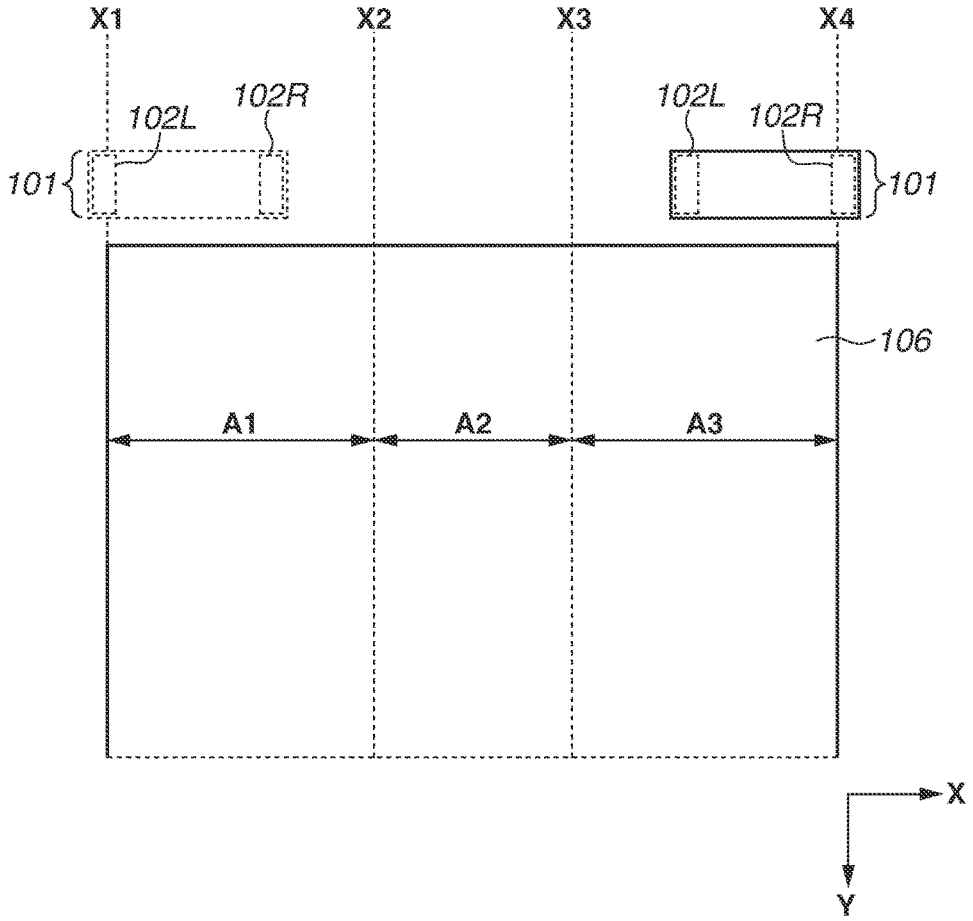
FIG. 3 is a diagram illustrating a printing method according to one or more aspects of the present disclosure.

FIG. 3 is a schematic diagram illustrating a state where printing is executed on the print medium 106 by using the printing unit 101. Of the two printing units 101 illustrated in FIG. 3, the printing unit 101 expressed by a dashed line positioned on the left side in the X-direction represents a position where the printing unit 101 starts printing with respect to the print medium 106 when scanning is executed from the left to the right in the X-direction. Further, the printing unit 101 expressed by a solid line positioned on the right side in the X-direction represents a position where the printing unit 101 ends printing with respect to the print medium 106 when scanning is executed from the left to the right in the X-direction.

Hereinafter, an end position on the left side in the X-direction of the print medium 106 is described as "position X1", and an end position on the right side in the X-direction of the print medium 106 is described as "position X4". Further, a predetermined position on the right side of the position X1 in the X-direction is described as "position X2", and a predetermined position on the left side of the position X4 in the X-direction is described as "position X3". Based on the positions X1 to X4 defined as the above, an area on the left side in the X-direction of the print medium 106 ranging from the position X1 to the position X2 is described as an area A1, an area at the center in the X-direction of the print medium 106 ranging from the position X2 to the position X3 is described as an area A2, and an area on the right side in the X-direction of the print medium 106 ranging from the position X3 to the position X4 is described as an area A3.

The area A1 is an area where ink is not discharged from the printing head 102R, and printing is executed only with ink discharged from the printing head 102L. The area A3 is an area where ink is not discharged from the printing head 102L, and printing is executed only with ink discharged from the printing head 102R.

On the other hand, the area A2 is an area (shared printing area) where printing operation is shared by the printing heads 102L and 102R and executed with ink discharged from both of the printing heads 102L and 102R. Accordingly, in the present exemplary embodiment, data corresponding to the area A2 is divided by executing printing head distribution processing described below, and printing data used for shared printing operation with respect to the area A2 to be executed by both of the printing heads 102L and 102R is generated.

As described above, in the present exemplary embodiment, the print medium 106 is divided into three areas in the X-direction, and printing operation is executed on the three areas, i.e., the area A1, the area A2 adjacent to the area A1 in the X-direction, and the area A3 adjacent to the area A2 in the X-direction, by changing the printing heads to be used for discharging ink. Specifically, printing operation is executed on the area A1 on the left side in the X-direction by discharging ink only from the printing head 102L, printing operation is executed on the area A3 on the right side in the X-direction by discharging ink only from the printing head 102R, and printing operation is executed on the area A2 at the center in the X-direction by discharging ink from both of the printing heads 102L and 102R.

Figure 4:
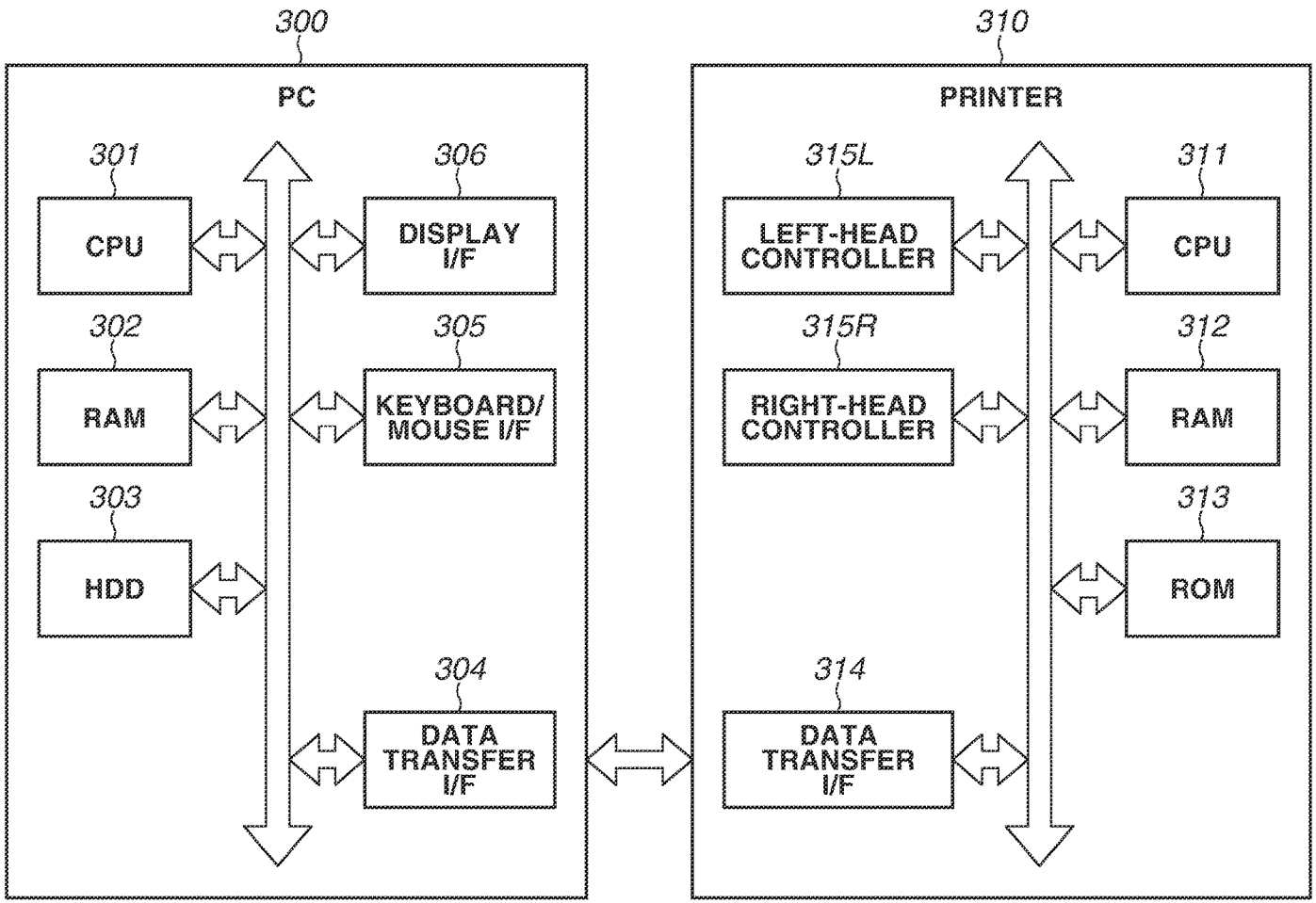
FIG. 4 is a block diagram illustrating a printing control system according to one or more aspects of the present disclosure.

FIG. 4 is a block diagram illustrating a schematic configuration of a printing control system according to the present exemplary embodiment. The printing control system of the present exemplary embodiment includes a printer 310 illustrated in FIG. 1 and a personal computer (hereinafter, referred to as "PC") 300 serving as a host apparatus of the printer 310.

The PC 300 is configured of the following elements. A central processing unit (CPU) 301 as an image processing unit executes processing according to a program stored in a random access memory (RAM) 302 or a hard disk drive (HDD) 303 serving as a storage unit, so as to generate red-green-blue (RGB) data expressed by respective colors of red (R), green (G), and blue (B) according to a printed image. The RAM 302 is a volatile memory which temporarily stores a program and/or data. The HDD 303 is a non-volatile memory which also stores a program and/or data. In the present exemplary embodiment, a data transfer interface (I/F) 304 controls transmission and reception of RGB data executed between the CPU 301 and the printer 310. The data transmission/reception can be executed through a connection method, such as a universal serial bus (USB), a serial bus compliant with the Institute of Electrical and Electronics Engineers (IEEE) 1394 standard, or a local area network (LAN). A keyboard/mouse I/F 305 is an interface for controlling a human interface device (HID), such as a keyboard and a mouse, and the user can input data via the keyboard/mouse I/F 305. A display I/F 306 controls display of a display device (not illustrated).

On the other hand, the printer 310 is configured of the following elements. A CPU 311 as an image processing unit executes respective pieces of processing described below according to a program stored in a RAM 312 or a read only memory (ROM) 313. The RAM 312 is a volatile memory which temporarily stores a program and/or data. The ROM 313 is a non-volatile memory which stores table data and a program used for various processing steps. In addition, a distribution pattern used for right/left heads distribution processing described below is also stored in the ROM 313.

A data transfer I/F 314 controls transmission and reception of data executed between the PC 300 and the printer 310.

A left-head controller 315L and a right-head controller 315R supply printing data to the printing heads 102L and 102R illustrated in FIG. 3, respectively, and controls printing operation of the printing heads 102L and 102R (i.e., printing control). Specifically, the left head controller 315L reads a control parameter and printing data from a predetermined address of the RAM 312. Then, when the CPU 311 writes the control parameter and the printing data to the predetermined address of the RAM 312, processing is started by the left head controller 315L, so that ink is discharged from the printing head 102L. Similarly, when the CPU 311 writes the control parameter and the printing data to the predetermined address of the RAM 312, processing is started by the right head controller 315R, so that ink is discharged from the printing head 102R.

Herein, although the printer 310 including only one CPU 311 has been described, the printer 310 may include a plurality of CPUs.

Figure 5:
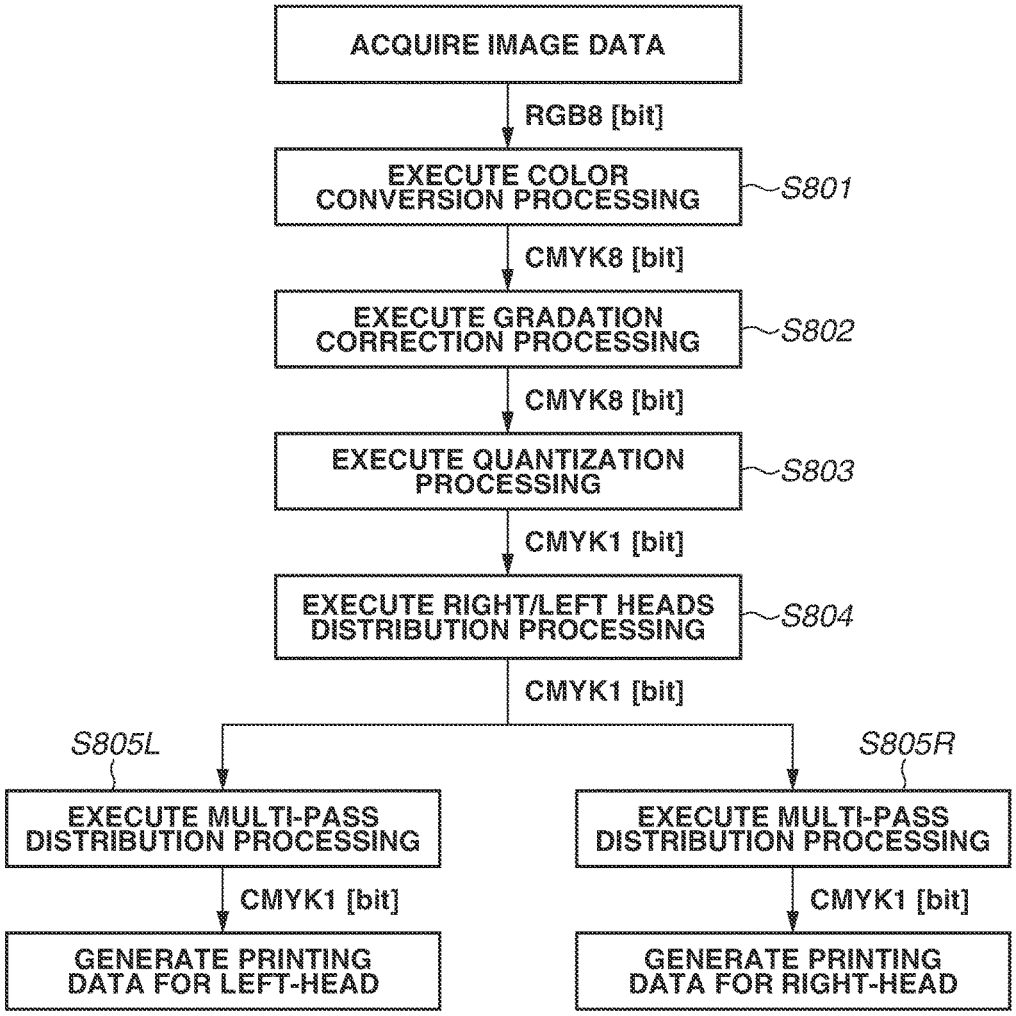
FIG. 5 is a flowchart illustrating image processing steps according to one or more aspects of the present disclosure.

FIG. 5 is a flowchart illustrating generation processing of printing data used for printing executed by the CPU 311 according to the control program of the present exemplary embodiment. This control program is previously stored in the ROM 313.

When the printer 310 acquires RGB data described in the RGB format from the PC 300, in step S801, the CPU 311 executes color conversion processing of converting the RGB data into ink color data corresponding to the colors of inks to be used for printing. Through the above color conversion processing, ink color data expressed by 8-bit (256-value) information which defines a gradation value of each of the pixels is generated. As described above, in the present exemplary embodiment, a black ink, a cyan ink, a magenta ink, and a yellow ink are used for printing. Therefore, pieces of ink color data each corresponding to a different one of color inks of black, cyan, magenta, and yellow are generated by the color conversion processing in step S801. Processing different from the one describe above may be executed as the color conversion processing as appropriate, and a three-dimensional look-up table (3D-LUT) in which a correspondence relationship between RGB values and CMYK values is specified, which is previously stored in the ROM 313, may be used. In addition, tetrahedron interpolation may be further executed.

In step S802, the CPU 311 executes gradation correction processing of correcting the gradation values indicated by the ink color data of respective CMYK values and generating gradation correction data expressed by 8-bit (256-value) information of the respective CMYK values. For example, one-dimensional look-up table (1D-LUT) in which a correspondence relationship between the ink color data corresponding to respective color inks before correction and the gradation correction data corresponding to respective color inks after correction is specified may be used for the gradation correction processing. This 1D-LUT is previously stored in the ROM 313.

In step S803, the CPU 311 executes quantization processing of quantizing the gradation correction data and generating quantization data (image data) expressed by 1-bit (binary value) information which defines discharge or non-discharge of color inks with respect to each of the pixels. Various types of conventionally-known processing, i.e., an error diffusion method or a dither matrix method may be executed as the quantization processing.

In step S804, the CPU 311 executes distribution processing in which quantization data corresponding to the area A2 of the print medium, from among the quantization data corresponding to respective color inks, is distributed to the printing heads 102L and 102R. Further, in the distribution processing, by taking a logical sum of the quantization data distributed to the printing head 102L and the quantization data corresponding to the area A1 of the print medium, the CPU 311 generates distribution data with respect to the print medium corresponding to the printing head 102L, which defines discharge or non-discharge of color inks from the printing head 102L to each of the pixels. Similarly, by taking a logical sum of the quantization data distributed to the printing head 102R and the quantization data corresponding to the area A3 of the print medium, the CPU 311 generates distribution data with respect to the print medium corresponding to the printing head 102R, which defines discharge or non-discharge of color inks from the printing head 102R to each of the pixels. This right/left heads distribution processing will be described below.

Then, in step S805L, the CPU 311 distributes the distribution data corresponding to the printing head 102L to a plurality of times of scanning (pass) performed on the same unit area of the print medium, and generates printing data for the printing head 102L used for discharging ink from the printing head 102L through the plurality of times of scanning. Similarly, in step S805R, the CPU 311 distributes the distribution data corresponding to the printing head 102R to a plurality of times of scanning, and generates printing data for the printing head 102R used for discharging ink from the printing head 102R through the plurality of times of scanning. In the present exemplary embodiment, the printing head 102L executes discharge operation according to the printing data for the printing head 102L generated in step S805L, and the printing head 102R executes discharge operation according to the printing data for the printing head 102R generated in step S805R. For example, the processing in steps S805L and S805R can be executed by using a plurality of mask patterns, corresponding to a plurality of times of scanning, in which a printing permitted pixel that defines permission of printing and a printing non-permitted pixel that defines non-permission of printing are arranged. In addition, the plurality of mask patterns are previously stored in the ROM 313. This multi-pass distribution processing will be described below.

Further, although the exemplary embodiment in which the CPU 311 of the printer 310 executes the entire processing in steps S801 to S805L and S805R has been described, all or a part of the processing in steps S801 to S805L and 5805 may be executed by the CPU 301 of the PC 300.

<Right/Left Heads Distribution Processing>

Figure 6A:
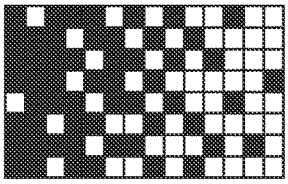
FIGS. 6A, 6B, and 6C are diagrams illustrating right/left heads distribution processing according to one or more aspects of the present disclosure.
Figure 6B:
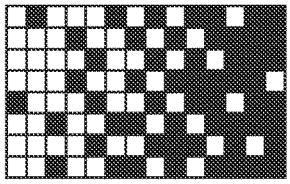
Figure 6B:
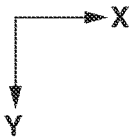

FIGS. 6A and 6B are schematic diagrams illustrating distribution patterns used for the right/left heads distribution processing executed in step S804. More specifically, FIG. 6A is a diagram schematically illustrating a distribution pattern for distributing the quantization data corresponding to the area A2 of the print medium to the printing head 102L. Further, FIG. 6B is a diagram schematically illustrating a distribution pattern for distributing the quantization data corresponding to the area A2 of the print medium to the printing head 102R. In each of the distribution patterns in FIG. 6A and 6B, a pixel filled with a black color represents a pixel to which discharge of ink is permitted when discharge of ink is defined by the quantization data. Further, an outlined white pixel represents a pixel to which discharge of ink is not permitted even if discharge of ink is defined by the quantization data. These distribution patterns are previously stored in the ROM 313.

Figure 6C:
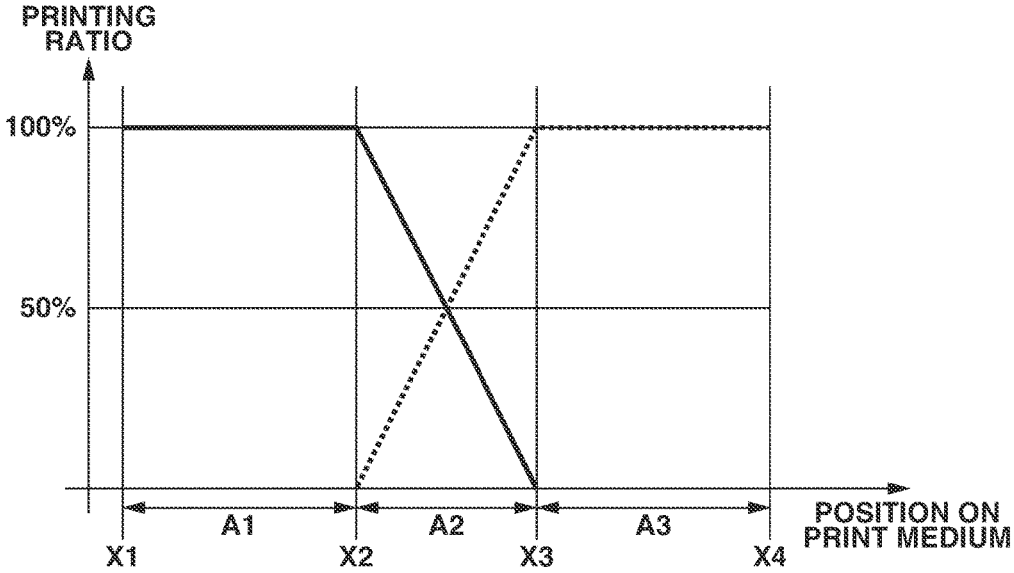

Furthermore, FIG. 6C is a diagram illustrating a result of right/left heads distribution processing which is executed in step S804 by using the distribution patterns in FIGS. 6A and 6B when the quantization data in which discharge of ink is defined with respect to all of the pixels (100% of quantization data) is input thereto. More specifically, a solid line indicates a printing ratio of the printing head 102L specified by a ratio of the distribution data corresponding to the printing head 102L to the quantization data before distribution. Further, a dashed line indicates a printing ratio of the printing head 102R specified by a ratio of the distribution data corresponding to the printing head 102R to the quantization data before distribution.

Herein, for the sake of simplicity, the area A2 will be described as an area having a size of 14 pixels in the X-direction. Accordingly, distribution patterns corresponding to the printing heads 102L and 102R illustrated in FIGS. 6A and 6B also have a size of 14 pixels in the X-direction. Further, each of the distribution patterns illustrated in FIGS. 6A and 6B consists of a size of 8 pixels in the Y-direction as one repeating unit, and the right/left heads distribution processing is completed with respect to the entire area A2 by repeatedly using these distribution patterns in the Y-direction. Practically, the right/left heads distribution processing is executed by applying distribution patterns of different sizes according to a size of the area A2.

As illustrated in FIGS. 6A and 6B, the distribution pattern corresponding to the printing head 102L and the distribution pattern corresponding to the printing head 102R define permission of ink discharge with respect to pixels mutually exclusive to and complementary with one another. Accordingly, for example, in a case where quantization data which defines discharge of ink with respect to all of the pixels is acquired as the quantization data corresponding to the area A2, the right/left heads distribution processing can be executed so as to discharge ink one time from any one of the printing heads 102L and 102R with respect to all of the pixels in the area A2.

Further, the distribution pattern corresponding to the printing head 102L illustrated in FIG. 6A defines permission/non-permission of ink discharge with respect to each of the pixels so as to make the number of pixels in which permission of ink discharge is defined be gradually decreased toward the right side from the left side of the area A2 in the X-direction. Therefore, as illustrated in FIG. 6C, a printing ratio of the printing head 102L is gradually decreased toward the right side from the left side of the area A2 in the X-direction.

On the other hand, the distribution pattern corresponding to the printing head 102R illustrated in FIG. 6B defines permission/non-permission of ink discharge with respect to each of the pixels so as to make the number of pixels in which permission of ink discharge is defined be gradually increased toward the right side from the left side of the area A2 in the X-direction. Therefore, as illustrated in FIG. 6C, a printing ratio of the printing head 102R is gradually increased toward the right side from the left side of the area A2 in the X-direction.

Herein, as illustrated in FIG. 6C, although the printing ratio of the printing head 102L and the printing ratio of the printing head 102R are mutually changed according to the position of the area A2 in the X-direction, a total of the ratios is 100% regardless of the position in the X-direction.

On the other hand, with respect to the area A1, a printing ratio of the printing head 102L is 100% because the quantization data is not distributed to the printing head 102R. Further, with respect to the area A3, the printing ratio of the printing head 102R is 100% because the quantization data is not distributed to the printing head 102L.

Accordingly, even if the right/left heads distribution processing of the present exemplary embodiment is executed, a discharge amount of ink with respect to the area A2 will not be deviated considerably from a discharge amount of ink with respect to the area A1 or A3.

Further, as illustrated in FIG. 6C, each of the printing ratio of the printing heads 102L and the printing ratio of 102R in the area A2 can be gradually changed in the X-direction.

For example, although a printing ratio of the printing head 102L is 100% and a printing ratio of the printing head 102R is 0% in the area A1, when printing of the area A2 is started, the printing ratio of the printing head 102L is gradually decreased toward the right side from the left side in the X-direction while the printing ratio of the printing head 102R is increased gradually. Then, in the area A3, the printing ratio of the printing head 102L is 0% and the printing ratio of the printing head 102R is 100%.

With this configuration, even if there arises difference in discharge properties of the printing heads 102L and 102R, it is possible to reduce unevenness of density between the areas A1 and A3 caused by difference in discharge properties. For example, when there arises difference in discharge properties that causes the discharge amount of the printing head 102L to be greater than the discharge amount of the printing head 102R, density becomes high (i.e., an image becomes dark) in the area A1 where printing is executed by the printing head 102L, and density becomes low (i.e., an image becomes thin) in the area A3 where printing is executed by the printing head 102R. If the above-described images having different density are printed at positions adjacent to each other, unevenness of density can be recognized easily since the density is changed so steeply. However, in the present exemplary embodiment, because printing ratios of the printing heads 102L and 102R are gradually changed in the area A2, density of the image is also changed gradually in the X-direction. Accordingly, it is possible to reduce unevenness of density since steeply change in density does not occur.

Further, in the distribution patterns illustrated in FIGS. 6A and 6B, although pixels in which permission of ink discharge is defined are gradually increased or decreased by 2 pixels in the X-direction, the exemplary embodiment is not limited thereto. For example, pixels in which permission of ink discharge is defined may be gradually increased or decreased by 4 pixels or 8 pixels in the X-direction.

<Multi-Pass Distribution Processing>

Hereinafter, multi-pass distribution processing executed in steps S805L and S805R of the present exemplary embodiment will be described in detail.

Figure 7A:
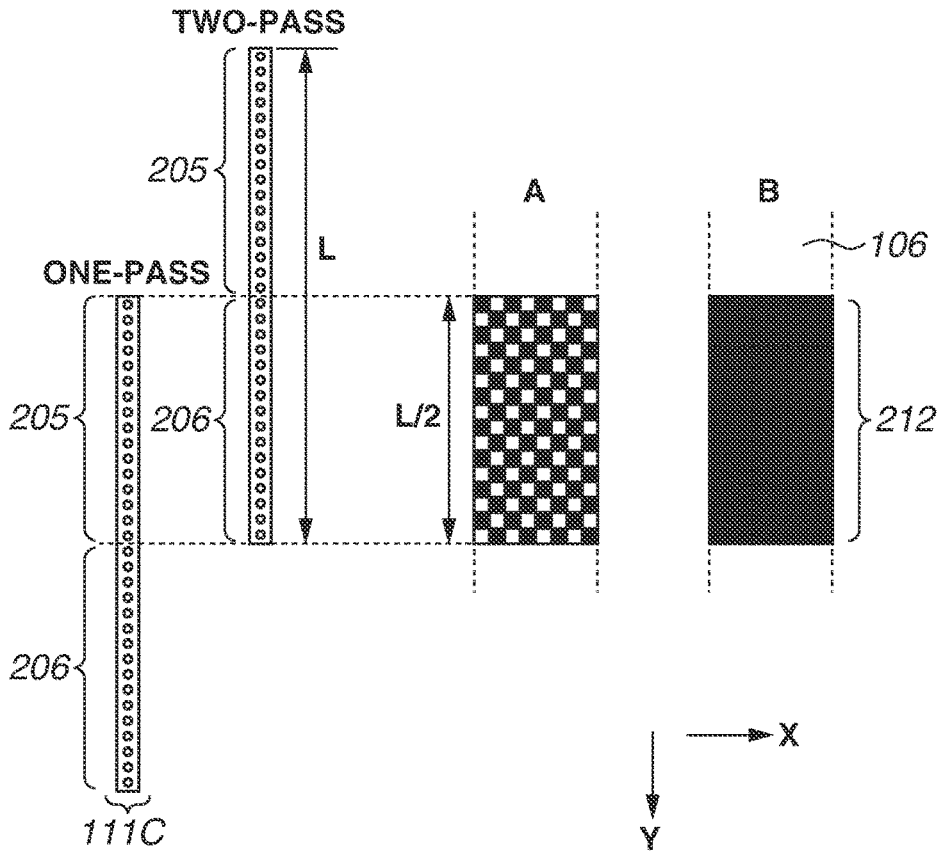
FIGS. 7A, 7B, and 7C are diagrams illustrating a multi-pass printing method according to one or more aspects of the present disclosure.
Figure 7B:
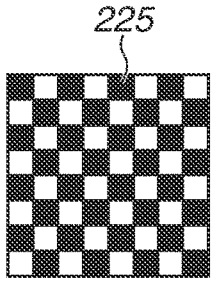
Figure 7C:
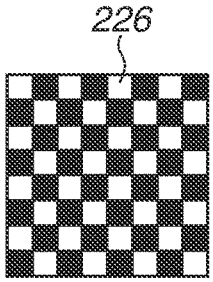

FIGS. 7A, 7B, and 7C are diagrams schematically illustrating mask patterns used for so-called "two-pass printing" in which printing is executed on a unit area of the print medium by making a printing unit execute scanning two times, and operation performed in two-pass printing. FIG. 7A is a diagram illustrating operation to be performed when printing is executed on a unit area 212 of the print medium through two-pass printing. FIGS. 7B and 7C are diagrams illustrating mask patterns applied when printing is executed on the unit area 212 in the first pass and the second pass. Herein, for the sake of simplicity, only the discharge port array 111C of the printing unit 101 will be described, while it is assumed that the discharge port array 111C consists of 32 discharge ports. Furthermore, one mask pattern consists of 64 pixels, i.e., 8 pixels in the X-direction by 8 pixels in the Y-direction, and distribution processing of the mask pattern is executed on the entire area by repeatedly applying the mask pattern in the X-direction.

A plurality of discharge ports in the discharge port array 111C is divided into two discharge port groups 205 and 206 in the Y-direction. Then, with respect to the unit area 212, ink is discharged from the discharge port group 205 in the first pass, and ink is discharged from the discharge port group 206 in the second pass. Therefore, in two-pass printing, the unit area 212 has a length L/2 corresponding to a length of one of the discharge port groups 205 and 206 in the Y-direction when the discharge port array 111C has a length L in the Y-direction.

At this time, a mask pattern 225 is used when printing data used for the first pass is generated. Similarly, a mask pattern 226 is used when printing data used for the second pass is generated.

Each of the mask patterns 225 and 226 consists of a plurality of printing permitted pixels for defining discharge of ink and printing non-permitted pixels for defining non-discharge of ink. In FIG. 7B or 7C, a portion filled with a black color represents a printing permitted pixel, and an outlined white portion represents a printing non-permitted pixel. With respect to the printing permitted pixel, printing data for discharging ink is generated when the input distribution data is data which describes discharge of ink. Further, with respect to the printing non-permitted pixel, printing data for not discharging ink is generated even if input data describes discharge of ink.

The printing permitted pixels in the mask patterns 225 and 226 are arranged at positions mutually different from each other where respective logical sums correspond to the entire pixels.

Hereinafter, operation of forming an image with printing duty of 100% (hereinafter, also referred to as "solid image") on the print medium 106 will be described. In the present exemplary embodiment, printing duty of a certain area is defined as 100% when ink is applied one time with respect to all of the pixel areas corresponding to the pixels existing in that area of the print medium 106.

In the first printing scan, ink is discharged to the unit area 212 of the print medium 106 from the discharge port group 205 according to the printing data generated by using the mask pattern 225. As a result, in the unit area 212, ink is discharged to the pixel areas filled with a black color as illustrated in A of FIG. 7A.

Next, the print medium 106 is relatively conveyed to a downstream from an upstream in the Y-direction by a distance L/2 with respect to the discharge port array 111C. With this operation, the discharge port array 111C and the print medium 106 have a positional relationship in which the discharge port group 206 and the unit area 212 face with each other.

After that, the second printing scan is executed. In the second printing scan, ink is discharged to the unit area 212 of the print medium 106 from the discharge port group 206 according to the printing data generated by using the mask pattern 226. After the second printing scan is executed, ink is applied to the pixel areas filled with a black color in the unit area 212 as illustrated in B of FIG. 7A.

As described above, after the second printing scan is executed, discharge of ink is completed with respect to all of the pixel areas in the unit area 212, as illustrated in B of FIG. 7A, so that a solid image is formed.

<Color Difference between Areas A1 and A3 when One-Pass Printing is executed>

Figure 8:
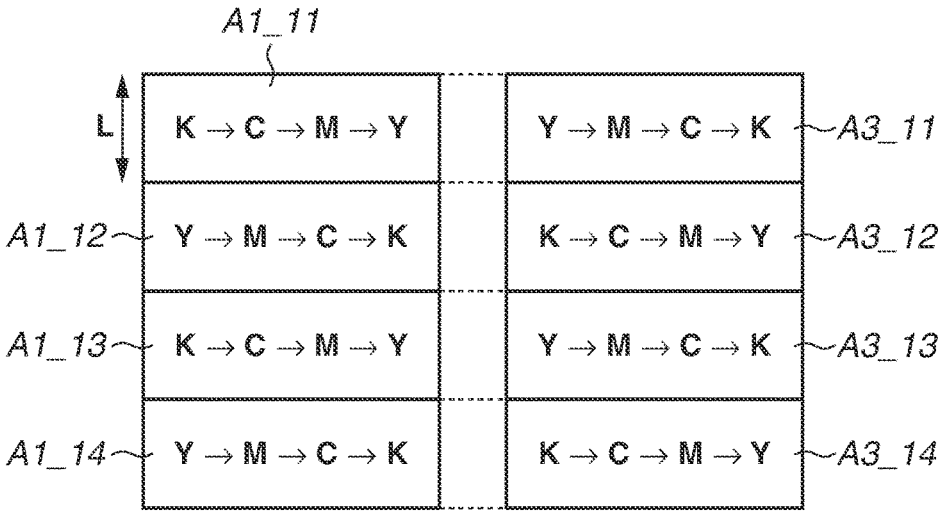
FIG. 8 is a diagram illustrating an application order of ink for one-pass printing according to one or more aspects of the present disclosure.

FIG. 8 is a diagram for describing color difference occurring in so-called "one-pass printing", in which scanning is executed one time with respect to a unit area on a print medium by using the printing unit 101 of the present exemplary embodiment. When one-pass printing is executed, because printing can be executed on the unit area having a width the same as a length L in the Y-direction of the discharge port array by one time of scanning, the unit area has a length L in the Y-direction. Further, for the sake of simplicity, description will be omitted with respect to the area A2.

Herein, printing is executed on unit areas one by one by alternately executing reciprocal scanning in the order of backward scanning (from right to left) and forward scanning (from left to right) with respect to the print medium. In other words, of the areas illustrated in FIG. 8, with respect to the odd-numbered areas from the top, i.e., the first areas A1_11, A3_11 and the third areas A1_13, A3_13 from the top, printing is executed through the backward scanning (from right to left). Further, with respect to the even-numbered areas from the top, i.e., the second areas A1_12, A3_12 and the fourth areas A1_14, A3_14 from the top, printing is executed through the forward scanning (from left to right).

As described above, the area A1 (i.e., areas A1_11 to A1_14) is an area where printing is executed by only the printing head 102L of the printing unit 101. Of the area A1, with respect to the areas A1_11 and A1_13 where printing is executed through the backward scanning (from right to left), ink is sequentially applied from a discharge port array arranged on the left side in the printing head 102L illustrated in FIG. 2. In other words, with respect to the areas A1_11 and A1_13, ink is applied in the order of black, cyan, magenta, and yellow. On the other hand, with respect to the areas A1_12 and A1_14 where printing is executed through the forward scanning (from left to right), ink is sequentially applied from a discharge port array arranged on the right side in the printing head 102L illustrated in FIG. 2. In other words, with respect to the areas A1_12 and A1_14, ink is applied in the order of yellow, magenta, cyan, and black.

Subsequently, the area A3 (i.e., areas A3_11 to A3_14) is an area where printing is executed by only the printing head 102R of the printing unit 101. Of the area A1, with respect to the areas A3_11 and A3_13 where printing is executed through the backward scanning (from right to left), ink is sequentially applied from a discharge port array arranged on the left side in the printing head 102R illustrated in FIG. 2, i.e., in the order of yellow, magenta, cyan, and black. On the other hand, with respect to the areas A3_12 and A3_14 where printing is executed through the forward scanning (from left to right), ink is sequentially applied from a discharge port array arranged on the right side in the printing head 102R illustrated in FIG. 2. In other words, with respect to the areas A3_12 and A3_14, ink is applied in the order of black, cyan, magenta, and yellow.

As illustrated in FIG. 8, when one-pass printing is executed by using the printing unit 101 of the present exemplary embodiment, the application order of ink is reversed in the areas arranged at the same position in the Y-direction. For example, although ink is applied to the area A1_11 in the order of black, cyan, magenta, and yellow, the ink is applied to the area A3_11 in the order of yellow, magenta, cyan, and black. Colors of the images become different when inks are applied in different orders. Thus, colors are different in the area A1_11 and the area A3_11 where color inks are applied in opposite orders. The image quality is lowered because of this color difference.

<Reduction of Color Difference between Areas A1 and A3 when Multi-Pass Printing is executed>

In consideration of the above-described issue, in the present exemplary embodiment, so-called "multi-pass printing" in which a plurality of times of scanning is executed on a unit area of the print medium is executed. Herein, two-pass printing in which printing is executed on a unit area through two times of scanning will be described as the multi-pass printing.

Figure 9:
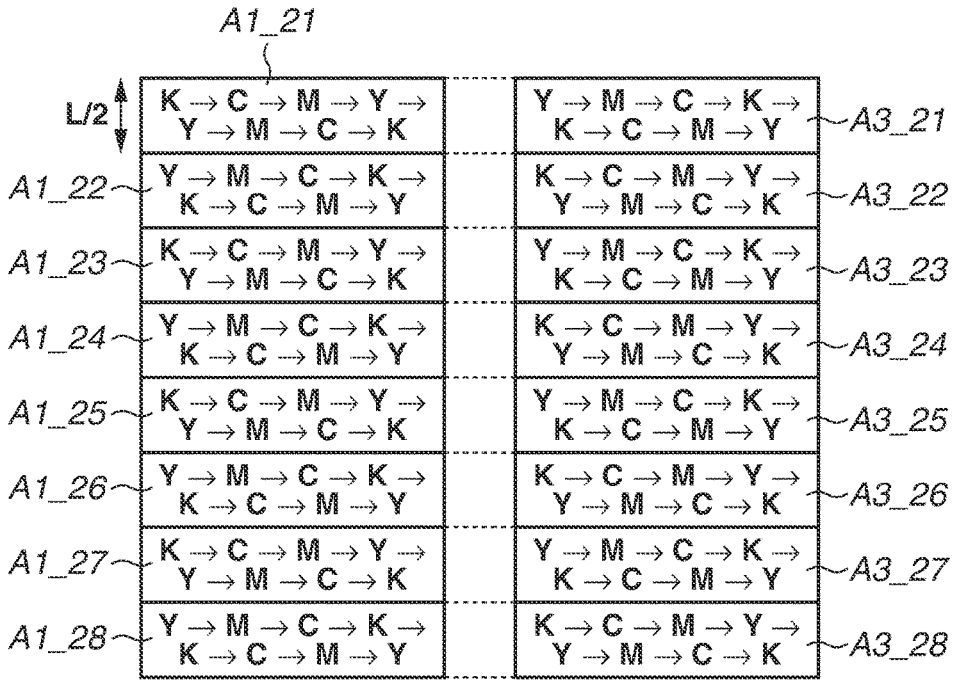
FIG. 9 is a diagram illustrating an application order of ink for multi-pass printing according to one or more aspects of the present disclosure.

FIG. 9 is a diagram for describing reduction of color difference when two-pass printing is executed on a unit area on a print medium by using the printing unit 101 of the present exemplary embodiment. As described above, when two-pass printing is executed, the unit area has a width L/2 in the Y-direction. Further, for the sake of simplicity, description will be omitted with respect to the area A2.

Similar to FIG. 8, in FIG. 9, printing is also executed on each of unit areas by alternately executing reciprocal scanning in the order of backward scanning (from right to left) and forward scanning (from left to right) with respect to the print medium. However, in FIG. 9, because printing operation is executed by two-pass printing, printing is executed on each unit area by executing one time each of forward scanning and backward scanning. Specifically, of the unit areas illustrated in FIG. 9, with respect to the odd-numbered areas from the top, i.e., the first areas A1_21, A3_21, the third areas A1_23, A3_23, the fifth areas A1_25, A3_25, and the seventh areas A1_27, A3_27 from the top, printing is executed through backward scanning (from right to left) first and the forward scanning (from left to right) next. On the other hand, with respect to the even-numbered areas from the top, i.e., the second areas A1_22, A3_22, the fourth areas A1_24, A3_24, the sixth areas A1_26, A3_26, and the eighth areas A1_28, A3_28 from the top, printing is executed through forward scanning (from left to right) first and backward scanning (from right to left) next.

Herein, the area A1 (i.e., areas A1_21 to A1_28) is an area where printing is executed by only the printing head 102L of the printing unit 101. Of the area A1, with respect to the areas A1_21, A1_23, A1_25, and A1_27 where printing is executed through backward scanning (from right to left) first and forward scanning (from left to right) next, ink is sequentially applied from a discharge port array arranged on the left side in the printing head 102L when the preceding backward scanning is executed. Then, ink is sequentially applied from a discharge port array arranged on the right side in the printing head 102L when the succeeding forward scanning is executed. Accordingly, in the areas A1_21, A1_23, A1_25, and A1_27, ink is applied in the order of black, cyan, magenta, yellow, yellow, magenta, cyan, and black.

On the other hand, with respect to the areas A1_22, A1_24, A1_26, and A1_28 where printing is executed through forward scanning (from left to right) first and backward scanning (from right to left) next, ink is sequentially applied from a discharge port array arranged on the right side in the printing head 102L when the preceding forward scanning is executed. Then, ink is sequentially applied from a discharge port array arranged on the left side in the printing head 102L when the succeeding backward scanning is executed. Accordingly, in the areas A1_22, A1_24, A1_26, and A1_28, ink is applied in the order of yellow, magenta, cyan, black, black, cyan, magenta, and yellow.

Next, the area A3 will be described. The area A3 (i.e., areas A3_21 to A3_28) is an area where printing is executed by only the printing head 102R of the printing unit 101. Of the area A3, with respect to the areas A3_21, A3_23, A3_25, and A3_27 where printing is executed through backward scanning (from right to left) first and forward scanning (from left to right) next, ink is sequentially applied from a discharge port array arranged on the left side in the printing head 102R when the preceding backward scanning is executed. Then, ink is sequentially applied from a discharge port array arranged on the right side in the printing head 102R when the succeeding forward scanning is executed. Accordingly, in the areas A3_21, A3_23, A3_25, and A3_27, ink is applied in the order of yellow, magenta, cyan, black, black, cyan, magenta, and yellow.

On the other hand, with respect to the areas A3_22, A3_24, A3_26, and A3_28 where printing is executed through forward scanning (from left to right) first and backward scanning (from right to left) next, ink is sequentially applied from a discharge port array arranged on the right side in the printing head 102R when the preceding forward scanning is executed. Then, ink is sequentially applied from a discharge port array arranged on the left side in the printing head 102R when the succeeding backward scanning is executed. Accordingly, in the areas A3_22, A3_24, A3_26, and A3_28, ink is applied in the order of black, cyan, magenta, yellow, yellow, magenta, cyan, and black.

In a case where two-pass printing is executed by using the printing unit 101 of the present exemplary embodiment, it is possible to bring the application orders of ink closer to each other in the areas arranged at the same position in the Y-direction. Particularly, as illustrated in FIG. 9, a part of the application order of ink in one area and a part of the application order of ink in another area can be equalized. For example, in the first half of the area A1_21 and the second half of the area A3_21, ink is similarly applied in the order of black, cyan, magenta, and yellow. Further, in the second half of the area A1_21 and the first half of the area A3_21, ink is similarly applied in the order of yellow, magenta, cyan, and black. As described above, although the application orders of ink in the areas A1_21 and A3_21 are not completely the same, a part of the application orders of ink can be equalized. Therefore, in comparison to the case where one-pass printing in FIG. 8 is executed, color difference between the areas A1_21 and A3_21 can be reduced, and image quality can be suppressed from being lowered.

<Comparative Embodiment>

Hereinafter, a comparative embodiment with respect to the first exemplary embodiment will be described.

In the comparative embodiment, a printing unit 121 on which printing heads 122L and 122R having a plurality of discharge port arrays arranged in the Y-direction are mounted is used.

Figure 10:
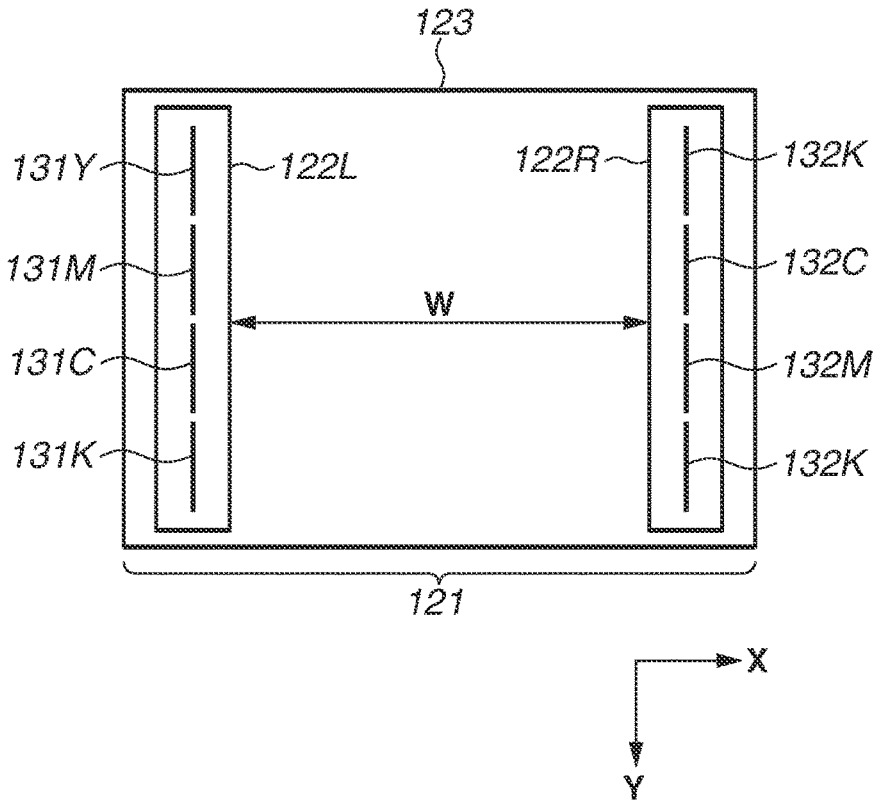
FIG. 10 is a diagram illustrating a printing unit according to one or more aspects of the present disclosure.

FIG. 10 is a diagram schematically illustrating the printing unit 121 used in the comparative embodiment, viewed from a vertically lower portion with respect to an X-Y plane.

The printing heads 122L and 122R are mounted on the printing unit 121 of the comparative embodiment, and these printing heads 102L and 102R have the same configuration. Further, the printing heads 122L and 122R are arranged in the printing unit 121 so as to be separated from each other by a distance W. Then, four discharge port arrays for discharging a cyan ink, a magenta ink, a yellow ink, and a black ink are arranged on each of the printing heads 122L and 122R.

Similar to the printing unit 101 used in the first exemplary embodiment, in the printing unit 121 used in the comparative embodiment, the two printing heads 122L and 122R are attached to a holding unit 123, so as to be placed in mutually opposite orientations in the Y-direction.

Specifically, when the printing head 122L is mounted on the printing unit 121, a yellow ink discharge port array 131Y, a magenta ink discharge port array 131M, a cyan ink discharge port array 131C, and a black ink discharge port array 131K are arranged in that order starting from the upper side in the Y-direction. On the contrary, when the printing head 122R is mounted on the printing unit 121, a black ink discharge port array 132K, a cyan ink discharge port array 132C, a magenta ink discharge port array 132M and a yellow ink discharge port array 132Y are arranged in that order starting from the upper side in the Y-direction. However, this arrangement is made based on the reason that the printing heads 122L and 122R are arranged in mutually opposite orientations in the Y-direction, and it is found that the printing heads 122L and 122R have the same configuration when the printing heads 122L and 122R are detached from the printing unit 121.

As described above, in the comparative embodiment, the printing heads 122L and 122R of the same configuration, on which discharge port arrays for discharging color inks are arranged in the Y-direction, are arranged on the printing unit 121 in mutually opposite orientations in the Y-direction.

<Color Difference between Areas A1 and A3 when One-Pass Printing is Executed>

Figure 11:
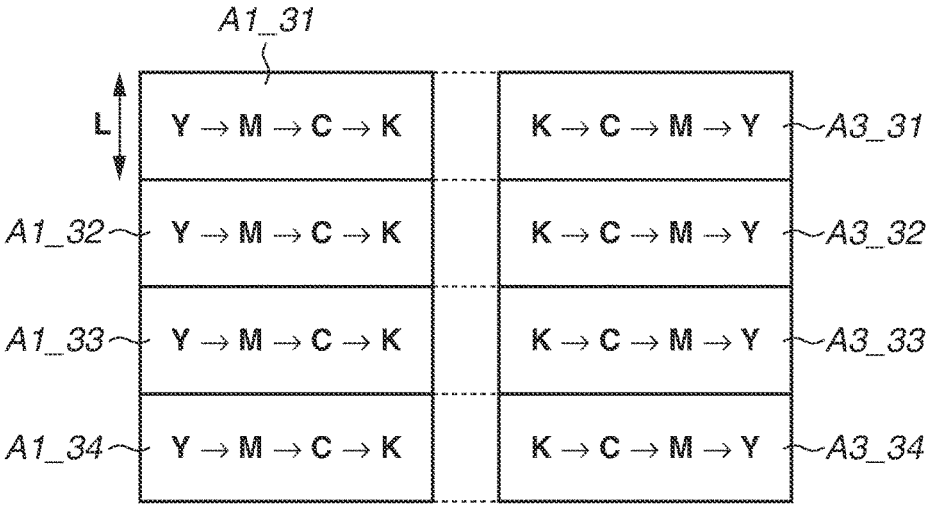
FIG. 11 is a diagram illustrating an application order of ink for one-pass printing according to one or more aspects of the present disclosure.

FIG. 11 is a diagram for describing color difference occurring when so-called "one-pass printing" is executed by using the printing unit 121 of the comparative embodiment. Herein, the following case will be described: printing is executed by alternately and repeatedly executing printing operation of discharging ink from a discharge port array with respect to the unit area along with one time of scanning performed by the printing unit 121 and conveyance operation of the print medium by a length L in the Y-direction of the discharge port array.

As illustrated in FIG. 10, each of the printing heads 122L and 122R includes a plurality of discharge port arrays arranged in the Y-direction. Accordingly, in the forward scanning and the backward scanning, application orders of ink are the same, and ink is sequentially discharged from a discharge port array on the upper side in the Y-direction.

Accordingly, the area A1 (i.e., areas A1_31 to A1_34) is an area where printing is executed by only the printing head 122L of the printing unit 121. Therefore, in each of the areas A1_31, A1_32, A1_33, and A1_34, ink is sequentially applied from a discharge port array arranged on the upper side in the printing head 122L illustrated in FIG. 10. In other words, with respect to the areas A1_31, A1_32, A1_33, and A1_34, ink is applied in the order of yellow, magenta, cyan, and black.

On the other hand, the area A3 (i.e., areas A3_31 to A3_34) is an area where printing is executed by only the printing head 122R of the printing unit 121. Therefore, in each of the areas A3_31, A3_32, A3_33, and A3_34, ink is sequentially applied from a discharge port array arranged on the upper side in the printing head 122R illustrated in FIG. 10. In other words, with respect to the areas A3_31, A3_32, A3_33, and A3_34, ink is applied in the order of black, cyan, magenta, and yellow.

As illustrated in FIG. 11, when one-pass printing is executed by using the printing unit 121 of the comparative embodiment, the application order of ink is reversed in the areas arranged at the same position in the Y-direction. For example, although ink is applied to the area A1_31 in the order of yellow, magenta, cyan, and black, the ink is applied to the area A3_31 in the order of black, cyan, magenta, and yellow. Therefore, color difference occurs in the areas A1_31 and A3_31, so that image quality is lowered.

<Color Difference between Areas A1 and A3 when Multi-Pass Printing is Executed>

Figure 12:
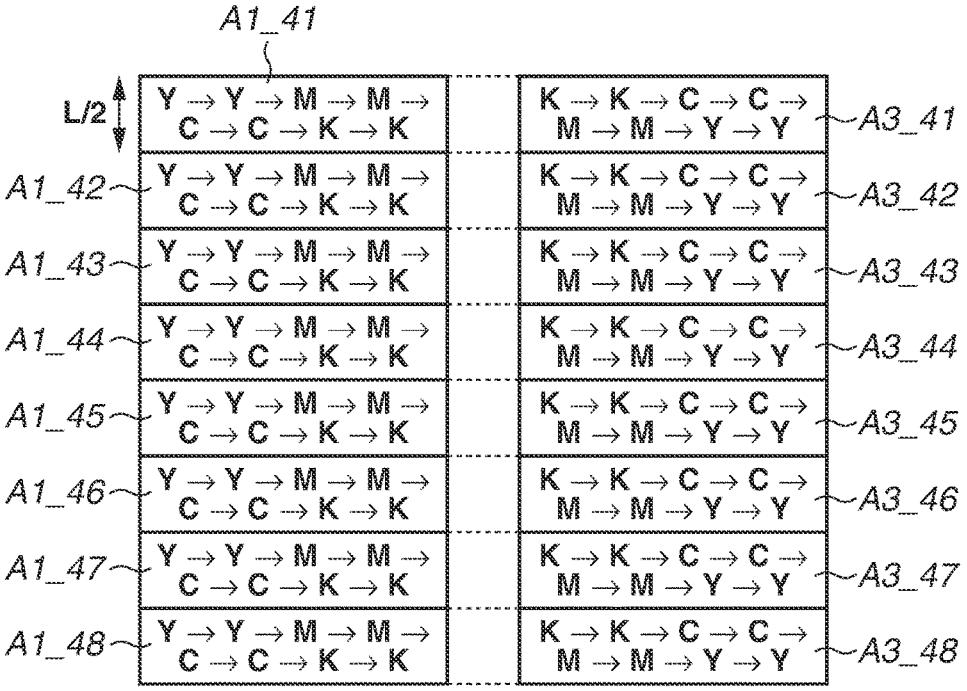
FIG. 12 a diagram illustrating an application order of ink for multi-pass printing according to one or more aspects of the present disclosure.

FIG. 12 is a diagram for describing color difference occurring when so-called "multi-pass printing" is executed by using the printing unit 121 of the comparative embodiment. Herein, color difference occurring when printing is executed by alternately and repeatedly executing printing operation of discharging ink from an upper half or a lower half of the discharge port array with respect to the unit area along with one time of scanning performed by the printing unit 121 and conveyance operation of the print medium by half a length (i.e., a length L/2) in the Y-direction of the discharge port array will be described.

Because a plurality of discharge port arrays is arranged in the Y-direction in each of the printing heads 122L and 122R, similar to the case of one-pass printing, ink is sequentially discharged from a discharge port array on the upper side in the Y-direction in both of the forward scanning and the backward scanning. However, since printing is executed on the unit area having a length L/2 through one time of scanning when two-pass printing is executed, each of the color inks are discharged twice.

Specifically, of the unit areas illustrated in FIG. 12, the area A1 (i.e., areas A1_41 to A1_48) is an area where printing is executed by only the printing head 122L of the printing unit 121. Therefore, in each of the areas A1_41 to A1_48, ink is sequentially applied from a discharge port array arranged on the upper side in the printing head 122L in FIG. 10 by twice per each color. In other words, with respect to the areas A1_41 to A1_48, ink is applied in the order of yellow, yellow, magenta, magenta, cyan, cyan, black, and black.

On the other hand, the area A3 (i.e., areas A3_41 to A3_48) is an area where printing is executed by only the printing head 122R of the printing unit 121. Therefore, in each of the areas A3_41 to A3_48, ink is sequentially applied from a discharge port array arranged on the upper side in the printing head 122R in FIG. 10 by twice per each color. In other words, with respect to the areas A3_41 to A3_48, ink is applied in the order of black, black, cyan, cyan, magenta, magenta, yellow, and yellow.

As illustrated in FIG. 12, even if multi-pass printing is executed by using the printing unit 121 of the comparative embodiment, similar to the case where one-pass printing is executed, the application order of ink is reversed in the areas arranged at the same position in the Y-direction. For example, when ink is applied to the area A1_41 in the order of yellow, yellow, magenta, magenta, cyan, cyan, black and black, the ink is applied to the area A3_41 in the order of black, black, cyan, cyan, magenta, magenta, yellow, and yellow. Therefore, color difference occurs between the areas A1_31 and A3_31, which lowers image quality.

As described above, when a printing unit illustrated in FIG. 10 on which two printing heads having discharge port arrays of a plurality of color inks arranged in the Y-direction are arranged in opposite orientations in the Y-direction is used, color difference between the areas A1 and A3 cannot be reduced even if multi-pass printing is executed.

As described above, when the printing unit on which two printing heads are arranged in opposite orientations in the Y-direction is used as described in the first exemplary embodiment, color difference between the areas A1 and A3 can be reduced by executing multi-pass printing. Further, although the multi-pass printing is effective in the configuration described in the first exemplary embodiment, in which each of the printing heads includes a plurality of discharge port arrays arranged in the X-direction, it is found that the same effect cannot be acquired in the configuration described in the comparative embodiment in which the plurality of discharge port arrays is arranged in the Y-direction.

Other Embodiments

Embodiment(s) of the present disclosure can also be realized by a computer of a system or apparatus that reads out and executes computer executable instructions (e.g., one or more programs) printed on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

Further, in the above-described exemplary embodiments, although two-pass printing is described as a multi-pass printing method, printing may be executed by three-pass or more.

Further, in the above-described exemplary embodiments, although a right and a left printing heads having the same configuration have been described, the exemplary embodiment is not limited thereto. Practically, as long as the arrangement orders of discharge ports of printing heads in the X-direction are the same, the same effect can be acquired by applying each of the above-described exemplary embodiments even if the configurations other than the above are different to some extent. However, it is preferable that the chip 113 arranged on the printing head 102L and the chip 114 arranged on the printing head 102R have the same configuration.

Further, in the above-described exemplary embodiments, although exemplary embodiments in which printing is executed by providing the area A2 where shared printing is executed by using both of the right and the left printing heads have been described, the exemplary embodiments are also applicable to a configuration in which the area A2 is not provided.

Furthermore, in the above-described exemplary embodiments, although multi-pass printing in which conveyance operation of a print medium is involved between the plurality of times of scanning has been described, the exemplary embodiments are also applicable to a configuration in which the conveyance operation is not executed.

Furthermore, in the above-described exemplary embodiments, although the printing unit on which the right and the left printing heads are arranged so as to be separated from each other by a certain distance (i.e., distance W) has been described, it is preferable that the distance W be at least longer than a distance d between the discharge port arrays of each of the printing heads. Since time taken for printing can be shortened if a distance between the printing heads is longer, practically, it is preferable that the printing heads be arranged so as to be separated from each other by such a distance that a desired printing time can be achieved thereby.

Further, in the above-described exemplary embodiments, although a discharge port array configured of one row consisting of a plurality of discharge ports for discharging the same type of ink arranged in the Y-direction has been described, the exemplary embodiments are not limited thereto. For example, one discharge port array may be configured of two rows consisting of a plurality of discharge ports for discharging the same type of ink arranged in the Y-direction, and the two rows may be arranged and shifted in the X-direction while discharge ports of one of the two rows are arranged at positions shifted from positions of discharge ports of another row in the Y-direction, so that the discharge ports of the one row can discharge ink to spaces between the discharge ports of another row.

Further, only discharge port arrays for discharging ink of chromatic colors such as cyan, magenta, and yellow may be arranged on each of the right and the left printing heads. Furthermore, only a discharge port array for discharging a black ink may be arranged on each of the right and the left printing heads.

According to the present disclosure, in a case where a printing unit on which a right and a left printing heads are arranged in opposite orientations is used, the printing apparatus can execute printing while reducing color difference between a right and a left areas.

While the present disclosure has been described with reference to exemplary embodiments, the scope of the following claims are to be accorded the broadest interpretation so as to encompass all such modifications and equivalent structures and functions.

This application claims the benefit of Japanese Patent Application No. 2016-233347, filed Nov. 30, 2016, which is hereby incorporated by reference herein in its entirety.

What is claimed is:

1. A printing apparatus comprising:

a printing unit which includes a first printing head on which a discharge port array consisting of a plurality of discharge ports for discharging ink arranged in a predetermined direction is arranged and a second printing head on which a discharge port array consisting of a plurality of discharge ports for discharging ink arranged in the predetermined direction is arranged, a holding unit for holding the first printing head and the second printing head wherein the held first printing head and the held second printing head being arranged so as to be separated a predetermined distance from each other in an intersection direction intersecting with the predetermined direction;

a scanning unit configured to scan a print medium by alternately moving the printing unit forward and backward in the intersection direction; and a control unit configured to control discharge of ink while causing the scanning unit execute scanning in such a manner that printing on a first area of the print medium is executed by using the first printing head without using the second printing head and printing on a second area different from the first area in the intersection direction of the print medium is executed by using the second printing head without using the first printing head, wherein a first plurality of discharge port arrays for discharging inks whose color types are different from one another is arranged on the first printing head in the intersection direction, and a second plurality of discharge port arrays for discharging inks whose color types are different from one another is arranged on the second printing head, wherein a combination of the color types of the inks discharged by the first plurality of discharge port arrays is identical to a combination of the color types of the inks discharged by the second plurality of discharge port arrays, wherein the first and the second printing heads are mounted on the holding unit in such a manner that said arrangement orders of the first and second plurality of discharge port arrays in the intersection direction are opposite from each other, and wherein the control unit controls the discharge of ink to a unit area included in the first area and the second area, respectively, in such a manner that an image is printed on the unit area while performing multiple scans of the first printing head and the second printing head, respectively, by discharging ink from the first plurality of discharge port arrays and the second plurality of discharge port arrays, respectively, through the multiple scans executed by the scanning unit.

2. The printing apparatus according to claim 1, wherein the control unit controls discharge of ink in such a manner that a third area of the print medium where printing is executed by using both of the first and the second printing heads is further formed.

3. The printing apparatus according to claim 1, wherein each discharge port array of the first plurality of discharge port arrays and of the second plurality of discharge port arrays is divided into a plurality of discharge port groups, and wherein the control unit controls the discharge of ink from each discharge port array for printing image on the unit area in such a manner that in mutually different scans among the multiple scans ink is discharged from mutually different discharge port groups of that discharge port array.

4. The printing apparatus according to claim 1, wherein the first and the second printing heads include chips having a same configuration, on which the plurality of discharge port arrays is arranged.

5. The printing apparatus according to claim 1, wherein the holding unit is provided with a first mounting unit on which the first printing head can be mounted and a second mounting unit on which the second printing head can be mounted in an orientation opposite to an orientation of the first printing head mounted on the first mounting unit in the predetermined direction.

6. The printing apparatus according to claim 1, wherein the first printing head and the second printing head are mutually arranged on the printing unit at a same position in the predetermined direction.

7. The printing apparatus according to claim 1, wherein the first area includes at least one end portion in the intersection direction of the print medium, and wherein the second area includes at least another end potion in the intersection direction of the print medium.

8. The printing apparatus according to claim 1, wherein the plurality of discharge port arrays of each of the first and the second printing heads includes a plurality of discharge port arrays for discharging different chromatic color inks.

9. The printing apparatus according to claim 1, wherein the plurality of discharge port arrays of each of the first and the second printing heads includes a discharge port array for discharging a black ink and a discharge port array for discharging a chromatic ink.

10. The printing apparatus according to claim 1, wherein the plurality of discharge port arrays of each of the first and the second printing heads is configured of only a plurality of discharge port arrays for discharging different chromatic color inks.

11. The printing apparatus according to claim 1, wherein the second plurality of discharge port arrays corresponds the first plurality of discharge port arrays in the intersection direction.

12. The printing apparatus according to claim 1, wherein the first printing head and the second printing head are detachable from the printing unit.

13. The printing apparatus according to claim 1, wherein each of the first printing head and the second printing head includes a tank for storing cyan ink, a tank for storing magenta ink, and a tank for storing yellow ink respectively.

14. The printing apparatus according to claim 1, wherein, when the first printing head and the second printing head are held by the holding unit, a center in the intersection direction of tanks for supplying ink to the first printing head is closer to a center in the intersection direction of the holding unit than a center in the intersection direction of the first plurality of discharge port arrays is, and a center in the intersection direction of tanks for supplying ink to the second printing head is closer to the center in the intersection direction of the holding unit than a center in the intersection direction of the second plurality of discharge port arrays is.

15. A printing method of executing printing by using a printing unit which includes a first printing head on which a discharge port array consisting of a plurality of discharge ports for discharging ink arranged in a predetermined direction is arranged and a second printing head on which a discharge port array consisting of a plurality of discharge ports for discharging ink arranged in the predetermined direction is arranged, a holding unit for holding the first printing head and the second printing head wherein the held first printing head and the held second printing head being arranged so as to be separated a predetermined distance from each other in an intersection direction intersecting with the predetermined direction, the printing method comprising:

scanning a print medium by alternately moving the printing unit forward and backward in the intersection direction; and controlling discharge of ink, while the scanning is executed, in such a manner that a first area and a second area are formed on the print medium, printing on the first area being executed by using the first printing head without using the second printing head and printing on the second area being executed by using the second printing head without using the first printing head, wherein a first plurality of discharge port arrays for discharging inks whose color types are different from one another is arranged on the first printing head in the intersection direction, and a second plurality of discharge port arrays for discharging inks whose color types are different from one another is arranged on the second printing head, wherein a combination of the color types of the inks discharged by the first plurality of discharge port arrays is identical to a combination of the color types of the inks discharged by the second plurality of discharge port arrays, wherein the first and the second printing heads are mounted on the holding unit in such a manner that said arrangement orders of the first and second plurality of discharge port arrays in the intersection direction are opposite from each other, wherein each discharge port array of the first plurality of discharge port arrays and of the second plurality of discharge port arrays is divided into a plurality of discharge port groups, and wherein the controlling controls the discharge of ink to a unit area included in the first area and the second area, respectively, in such a manner that ink is discharged on the unit area while performing multiple scans of the first printing head and the second printing head, respectively, while executing the multiple scans by the scanning.

16. The printing method according to claim 15, wherein the controlling controls discharge of ink in such a manner that a third area of the print medium where printing is executed by using both of the first and the second printing heads is further formed.

17. The printing method according to claim 15, wherein the first area includes at least one end portion in the intersection direction of the print medium, and wherein the second area includes at least another end potion in the intersection direction of the print medium.

18. The printing method according to claim 15, wherein the plurality of discharge port arrays of each of the first and the second printing heads includes a plurality of discharge port arrays for discharging different chromatic color inks.

19. The printing method according to claim 15, wherein the plurality of discharge port arrays of each of the first and the second printing heads includes a discharge port array for discharging a black ink and a discharge port array for discharging a chromatic ink.

20. The printing method according to claim 15, wherein the plurality of discharge port arrays of each of the first and the second printing heads is configured of only a plurality of discharge port arrays for discharging different chromatic color inks.

21. The printing method according to claim 15, wherein the first printing head and the second printing head are detachable from the printing unit.

* * * * *